US009990785B2

(12) United States Patent
God et al.

(10) Patent No.: US 9,990,785 B2
(45) Date of Patent: Jun. 5, 2018

(54) ACCESS SYSTEM FOR A VEHICLE AND METHOD FOR MANAGING ACCESS TO A VEHICLE

(71) Applicant: Airbus Operations GmbH, Hamburg (DE)

(72) Inventors: Ralf God, Hamburg (DE); Hartmut Hintze, Schwarzenbek (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 317 days.

(21) Appl. No.: 14/295,537

(22) Filed: Jun. 4, 2014

(65) Prior Publication Data

US 2016/0148449 A1 May 26, 2016

Related U.S. Application Data

(63) Continuation of application No. PCT/EP2012/076789, filed on Dec. 21, 2012.
(Continued)

(30) Foreign Application Priority Data

Dec. 22, 2011 (DE) ..... 10 2011 122 461

(51) Int. Cl.
*G07C 9/00* (2006.01)

(52) U.S. Cl.
CPC ..... *G07C 9/00087* (2013.01); *G07C 9/00103* (2013.01); *G07C 9/00817* (2013.01); *G07C 2009/00095* (2013.01)

(58) Field of Classification Search
CPC .... H04W 4/008; H04L 67/12; G07C 9/00103; G07C 9/00817
(Continued)

(56) References Cited

U.S. PATENT DOCUMENTS 6,041,410 A * 3/2000 Hsu ..... G06K 9/00013 380/285
6,376,930 B1 * 4/2002 Nagao ..... G07C 9/00158 307/10.2
(Continued)

FOREIGN PATENT DOCUMENTS

WO 2006021047 A1 3/2006

OTHER PUBLICATIONS

ISA, International Search Report for International Application PCT/EP2012/076789, dated Apr. 8, 2013.
(Continued)

*Primary Examiner* — Vernal Brown
(74) *Attorney, Agent, or Firm* — Lorenz & Kopf, LLP

(57) ABSTRACT

An access system for a vehicle is provided. The access system includes a central rights management unit, an access control device, and a portable identification medium. The access control device makes it possible to run verification mechanisms on the identification medium with the use of input means for interacting with a user. To this effect the identification medium includes an authentication unit and also a data part that depends on it which for viral epidemic propagation of privilege data may forward this data to access control devices without its own data connection. Even in the case of an incomplete infrastructure, extensive vehicle movements and very substantial fluctuations in personnel it is nevertheless possible to achieve very high security and reliability of enabling access and vehicle functions.

9 Claims, 5 Drawing Sheets

Related U.S. Application Data

(60) Provisional application No. 61/579,309, filed on Dec. 22, 2011.

(58) Field of Classification Search
USPC ..... 340/5.6
See application file for complete search history.

(56) References Cited

U.S. PATENT DOCUMENTS

| | | | | |
|---|---|---|---|---|
| 6,617,961 | B1 * | 9/2003 | Janssen | B60R 25/245 307/10.1 |
| 6,853,894 | B1 * | 2/2005 | Kolls | G01M 17/007 340/426.36 |
| 6,877,097 | B2 | 4/2005 | Hamid et al. | |
| 7,406,368 | B2 * | 7/2008 | Arnouse | B64D 45/0015 244/118.5 |
| 7,475,812 | B1 | 1/2009 | Novozhenets et al. | |
| 8,052,060 | B2 | 11/2011 | Yacoub et al. | |
| 8,566,250 | B2 | 10/2013 | Russell et al. | |
| 2003/0023882 | A1 | 1/2003 | Udom | |
| 2004/0064415 | A1 | 4/2004 | Abdallah et al. | |
| 2006/0107067 | A1 | 5/2006 | Safal et al. | |
| 2009/0187759 | A1 * | 7/2009 | Marsico | H04L 63/0428 713/155 |

OTHER PUBLICATIONS

German Patent and Trade Mark Office, German Search Report for German Patent Application No. 102011122461.4, dated Aug. 2, 2012.

* cited by examiner

ACCESS SYSTEM FOR A VEHICLE AND METHOD FOR MANAGING ACCESS TO A VEHICLE

CROSS-REFERENCE TO RELATED APPLICATIONS

This is a continuation of International Application No. PCT/EP2012/076789, filed Dec. 21, 2012, which application claims priority to German Patent Application No. 10 2011 122 461.4, filed Dec. 22, 2011, and to U.S. Provisional Patent Application No. 61/579,309, filed Dec. 22, 2011, which are each incorporated herein by reference in their entirety.

TECHNICAL FIELD

The technical field relates to an access system for a vehicle and to a method for managing access to a vehicle.

BACKGROUND

Access to security-critical equipment, for example commercial transport aircraft and the operation of their systems, is subject to stringent security requirements, in particular in the case of commercial aircraft. Despite a continuously rising number of commercial aircraft in operation and currently available methods and systems for managing access authorization, access management, for example relating to commercial aircraft, is usually based on authorization by entering passwords. These passwords need to be distributed to the corresponding commercial aircraft and to the authorized users by means of secure, and thus expensive, information transfer. On access control devices in front of, on, or near the aircraft or in the aircraft itself, a user subsequently authenticates and authorizes themselves by communicating to the aircraft the password known to them.

In addition, other objects, desirable features and characteristics will become apparent from the subsequent summary and detailed description, and the appended claims, taken in conjunction with the accompanying drawings and this background.

SUMMARY

Communicating passwords to users and secure transmission of passwords to access control devices is expensive. Furthermore, an access control device that exclusively relies on a password itself may encourage misuse. Moreover, it is possible that, for example, a commercial aircraft does not have a corresponding data connection in order to, at an airport, receive a set of passwords and the like for access control, and consequently it is possible for outdated passwords to be used or always the same password to be distributed to all users under consideration.

According to various embodiments, provided is an access system for a vehicle and a method for managing access to a vehicle, which access system does not depend on a data link and furthermore provides particularly good security for the authentication of a user.

In one embodiment the access system for a vehicle comprises a central rights management unit, at least one access control device, at least one portable identification medium, and input means for interacting with a user, wherein the rights management unit is adapted for interlinking and provide user identification and associated user rights, wherein the access control device comprises a connecting means for connection with the identification medium, wherein the access control device is adapted for enabling the associated user rights to an authorized user, and wherein the identification medium comprises an authentication unit and is adapted, in the authentication unit, for running through verification mechanisms for user authentication, and for transmitting to the access control device information relating to authentication that has been carried out.

Thus a significant core of the present disclosure consists of the logical and hardware-supported separation of the actual authentication process of the user and of the authorization procedure. Authentication is to be considered to be verification of the genuineness of the stated identity of a user. According to the various teachings of the present disclosure, authentication of a user takes place in that a user takes the identification medium assigned to them to the connecting means of the access control device so that a connection between the access control device and the identification medium may be established. The input means may then be used to provide input to the verification mechanisms running in the identification medium, which input may comprise text information, image information and sound information.

According to the various teachings of the present disclosure, authentication is carried out based on feature elements "possession" of the information medium, "knowledge" of a password or other secret, and one or several physical or biometric features, for example a fingerprint, an iris scan, a voice sample or the like. Using a combination of these characteristics, which may be verified by means of the verification mechanisms inherent on the identification medium by way of the input means of the access control device, a particularly high level of security may be achieved during authentication of a user. The aforesaid is particularly due to the biometric features of the user, because these are practically secure against forgery. Furthermore, it is not necessary to transmit sensitive data, for example specific user data or biometric features, to an access control device or a higher-order system and in that location to store said data either temporarily or permanently.

In one embodiment of a system according to the present disclosure, for improving security of the system, it may be sensible, prior to the start of an authentication process, to have the access control device verify whether the identification medium used for authentication is known to the system and its use is permitted. This process may be carried out before, during or after authentication.

Decoupled from authentication, authorization of a user on the vehicle takes place on the basis of central rights that are managed outside the vehicle, which rights are stored by the central rights management unit. To this effect, for various predefined user groups with their respective roles, specific privilege schemes are defined by said central rights management unit. The user groups may, for example, comprise vehicle attendants, cleaning personnel, maintenance personnel or other types of users. For this purpose an assignment table may comprise data fields that may be linked to concrete user privileges in further data fields. The later may, for example, represent the general privilege of entering the vehicle and operating one or several vehicle systems. For example, the user group "cleaning personnel" might be allowed to switch on the illumination within the vehicle and to use defined power points for cleaning devices, while, however, operation of the air conditioning system, of an on-board entertainment system or of other equipment that is not required for cleaning the vehicle may be blocked. It is sensible, in a one-off procedure, to already deposit in the vehicle the basic user groups with their respective privileges, and to bring in from the outside an assignment table that links users to user groups. Assignment of changing users to these user groups accordingly takes place centrally, outside the aircraft, in the rights management unit.

In the simplest case the term "authorization basis" may refer to an assignment table that assigns individual users to the individual user groups. It is understood that, in particular in the use relating to aircraft, because of an overall large number of users, an assignment table may be very dynamic. Due to the normal fluctuations of personnel and the change in operational areas of individual users or individual privileges, changes may always be required. As a result of the dynamic assignment and the authentication, which is logically separate from the aforesaid, it is not necessary to communicate to the users constant vehicle-related secrets such as, for example, passwords or PINs, which in the vehicle result in the defined privilege schemes being enabled.

Authorization in the form of enabling a defined privilege scheme on and in the vehicle takes place on the basis of information from the authentication unit, according to which information the identity of the user who has a predefined role is ensured. Thus, as soon as authentication has been successful the privilege scheme assigned to the role of a user in relation to the vehicle may be enabled for said user. In this process of authorization itself, no authentication features of the user are checked. Correspondingly, for this process no information relating to specific feature elements of users needs to be present at the access control device or at a higher-order system.

The logical separation of user authentication from user authorization only becomes possible in that a transportable identification medium is used, which is to be carried on the person by the user. Before any authentication and subsequent authorization of the user becomes possible at all, the identification medium is individually issued in a one-off process, wherein the individual verification mechanisms for the specific user are compiled and are permanently transferred to the identification medium. The identification medium is subsequently handed over to the user. Any inadvertent mix-up or any theft of the identification medium is not serious, because the verification mechanisms are, in particular as a result of the biometric features of the user, only applicable to this user. Furthermore, by being in possession of the identification medium it is practically no longer possible to obtain biometric or other specific data of the rightful owner. In this way protection against misuse may be improved in that the underlying data is stored in the authentication unit so as to be encrypted and may only be made available again in the authentication unit, for example, by means of a cryptography device for executing the verification mechanisms.

The system according to the present disclosure is, in particular, suitable for use in security-critical installations, for example in commercial airports. Commercial air traffic is, among other things, characterized in that commercial aircraft are regularly situated on commercial airports. The safety (so-called air safety) of infrastructures for example on German commercial airports is governed by the Aviation Security Act (LuftSiG) that takes into account the regulation (EC) nr 2320/2002 of the European Parliament and of the Council establishing common rules in the field of civil aviation security. In particular, in relation to commercial airports said act defines which persons may be issued with authorization of access to regions that are not generally accessible, provided the prerequisites are met; or conversely, which persons are to lose authorization of access if the prerequisites are no longer met. The act governs the requirements relating to security measures of the airport operators and of the air carriers in relation to the infrastructures on commercial airports, as well as access approval, to persons, to sensitive areas.

However, in the above-mentioned document, the sensitive area of the commercial aircraft itself is not explicitly set out, but only implicitly governed by way of the airport requirements. Access management to commercial aircraft may analogously result from the legal requirements. For example, members of an aircrew are obliged to carry on the person identification documents (§ 10 LuftSiG) that have been issued after a positively assessed reliability check (§ 7 LuftSiG). Such an identification document is usually based on a photo and printed person-related data and is used to gain access to security-critical, delimited zones and to commercial aircraft. An identification medium in the sense of the present disclosure may generally be designed like a conventional photo identification document, which, however, fulfils the additional functions as described above.

Service and maintenance personnel are also obliged to carry identification in order to use sensitive infrastructures. In the context of service and maintenance, personnel also have privileges for access to sensitive regions and systems of the aircraft, which privileges may go far beyond normal operation of the aircraft. When service and maintenance work is carried out, the access system generally at the same time also supports electronic documentation of the work carried out. For example, a technician equipped with built-in test equipment (BITE) is able, if required, to access, carry out and test system functions in test mode. If enabling such a test mode takes place by way of an access system according to the present disclosure, the carried-out system tests and their results may be automated in a job-specific manner and may be documented in an electronic logbook of the aircraft in a person-related manner.

Theoretically the access system according to the present disclosure may also be used for passengers who, predominantly with baggage, at the airport move through the individual security zones to the aircraft. In the aircraft, these passengers use, for example, the on-board entertainment system, on-board sales or other services provided. The identification medium may, for example, be implemented in the form of a frequent flyer card. Based on automated authentication, as a user incentive, for example a passenger voluntarily registered in a central database of the air carrier may make use of various self-service facilities on the airport or gain access to lounges. When a passenger takes up their seat in the aircraft and authenticates themselves by means of their electronic identification medium, for example the boarding list and the loading of baggage may automatically be checked. At the same time, at the seat, passenger-related personalized service and entertainment services of the air carrier may be enabled. Furthermore, the identification medium may comprise payment functions or redemption of reward points which beforehand have used the secure authentication of the identification medium.

In one embodiment the authentication unit is adapted for transmitting to the access control device information relating to successful authentication of a user and abstract user identification. The latter is defined by a user ID or similar expressions that are decoupled from real names or other data of personal users. Thus the authentication part carries out the entire authentication of the user and after successful execution may communicate to the outside that authentication was successful and may state what identification the authenticated user has. By means of the privilege schemes centrally assigned to the user identification, authorization of the user may take place.

In one embodiment the identification medium comprises an independent data part for storing user privilege data. The user privilege data comprises a correlation between abstract user identification and associated privilege schemes or user roles. The data stored in the data part need not necessarily be associated with the respective rightful holder of the identification medium; instead, said data may also relate to a group of users. This is a particularly big advantage in the case of vehicles, and in particular aircraft, which cannot at every location of use establish a data connection with a central rights management unit. It would be sufficient, in relation to a user, to store updated user privilege data on an identification medium so that said user relays the information when accessing the access control device. The data necessary for authorization is thus conveyed by so-called viral or epidemic propagation. In this arrangement a predominant usage frequency, which in the case of commercial aircraft is usually high, nevertheless makes it possible to maintain data in a highly updated state. In particular in the case of maintenance personnel this makes it possible to carry along job-specific enabling even if an external employee travels to an airport that does not have a direct database connection to a central rights management unit. In addition, this function of the identification medium may ensure that when a passenger leaves an airport, information relating to checked-in items of baggage, or data relating to bonus points of frequent flyer programs are provided by a central database. Furthermore, it is relatively easy to implement a blacklist which withdraws various privileges from particular users. If a user who originally had a particular privilege authenticates themselves at the particular vehicle, an updated assignment of users to privileges may be taken into account immediately despite the absence of a data connection of the vehicle.

Transferring data between an access control device and an identification medium may, for example, take place during or after user authentication so that the respective user cannot actively influence or stop this important transfer that on said user's identification medium data is stored that allows or denies other users access to user-specific rights. This system, which uses viral epidemic propagation of data and information, favors maintaining relevant security regulations, in particular in an aviation-related field.

In one embodiment the identification medium comprises an electrical interface as a connecting means, which electrical interface is adapted for establishing a contact-based connection to an access control device. In its authentication unit the identification medium comprises an arrangement of arithmetic units and storage units that are designed to execute individual verification mechanisms. An electrical connection is sensible at least for the supply of electrical energy to the identification medium when the identification medium does not comprise its own energy supply. Furthermore, if the identification medium does not comprise its own input means, for operation it would be necessary to use input means of the access control device. A contact-based interface supports safe and temporarily reliable establishment of an electrical connection, and furthermore this type of connection distinguishes itself by its ease of establishment and its economical nature when compared to alternative forms of connections.

In one embodiment the identification medium comprises a transmitting and receiving device that is adapted, for the purpose of data transmission, for wirelessly communicating with an external transmitting and receiving device. To this effect the transmitting and receiving device integrated in the identification medium comprises at least one antenna that is in communication with a corresponding electronic circuit that carries out corresponding transmission modulation and receiving de-modulation. Wireless communication provides a particular advantage in that as a result of there not being a need to provide a contact-based connection the identification medium may be fully encapsulated, for example by means of a plastic sheath, so that to the largest extent possible it is protected against environmental influences and provides improved reliability when compared to that of a contact-based interface. Particularly advantageously the transmitting and receiving device is designed in such a manner that the transmitting and receiving device is supplied externally with the necessary operating voltage by means of an induction circuit so that the identification medium may be operated without an energy storage device, for example a battery. The induction circuit may comprise a primary coil in the region of the connecting means, and a secondary coil in the identification medium, which in the case of an identification medium brought to the connecting means are arranged so as to be largely flush with each other, thus forming a transmitting device. The primary coil and the secondary coil may at the same time also be used for data transmission. Transmitting electrical energy may take place at intervals by way of a buffer storage device or continuously.

In one embodiment the identification medium is adapted for providing priority features, wherein the access control device is adapted for calling up priority features from the identification medium and to compare them with priority features relating to other known user privilege data, for example called up from other identification media. This is particularly important to protect a decentrally organized network based on viral epidemic propagation of data, from using old or outdated data as a basis for user privileges. For example, if a user has an identification medium that keeps user privilege data that differs from the identification medium of some other user, the more up-to-date user privilege data is preferred. A time stamp or an indication of the time of the last update that has taken place may be used as a priority feature, which time stamp or indication of time is to be compared to priority features of other user privilege datasets.

In one embodiment a first access control device is provided that is situated outside the vehicle. Such a first access control device may, for example, be present in an airport building or on airport grounds and may be situated between a public area and a secure area. In order to gain access to the secure area, airport personnel would have to present themselves with their identification medium on the first access control device in order to carry out authentication at that location.

In one embodiment the first access control device comprises a data connection to the central rights management unit. The connection generally takes place by way of a secure wire-bound network. A user who presents at this first access control device carries out authentication by means of their identification medium, wherein the first access control device calls up the current user privileges, in other words an updated assignment of the user to privilege schemes, from the central rights management unit, in order to subsequently, after authentication, make possible corresponding authorization by enabling the assigned user privileges. Authorization would, for example in the case of correspondingly existing positive privileges, trigger a signal on the access control device that results in the opening of a door that allows access to the security protected area. In this authentication and the subsequent authorization an updated user assignment may be stored on the rights allocation unit of the identification medium. The user entering the security-relevant area of the airport would then carry an updated user assignment on the person.

In one embodiment the first access control device does not comprise a data connection to the central rights management unit. This first access control device may, for example, be arranged in retrofitted access points on airport grounds and may acquire a knowledge of current rights assignments on the basis of rights assignments that are called up from identification media. At the same time this second access control device may carry out all the steps stated above. These steps involve, for example, comparing rights assignments on subsequently brought-in identification media, storing updated rights assignments on subsequently brought-in identification media and the like.

In one embodiment there is a second access control device that is arranged on or in the vehicle and that is adapted for enabling operation of vehicle systems based on privileges of an authenticated user.

According to various embodiments, a method is provided, which method comprises the method-related steps presented above. In this method, access to a vehicle may comprise entering an area in which a vehicle is located, as well as access to a system installed in the vehicle. The method thus describes a method for controlling access to a vehicle or to a vehicle system.

A person skilled in the art can gather other characteristics and advantages of the disclosure from the following description of exemplary embodiments that refers to the attached drawings, wherein the described exemplary embodiments should not be interpreted in a restrictive sense.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Figure 1A:
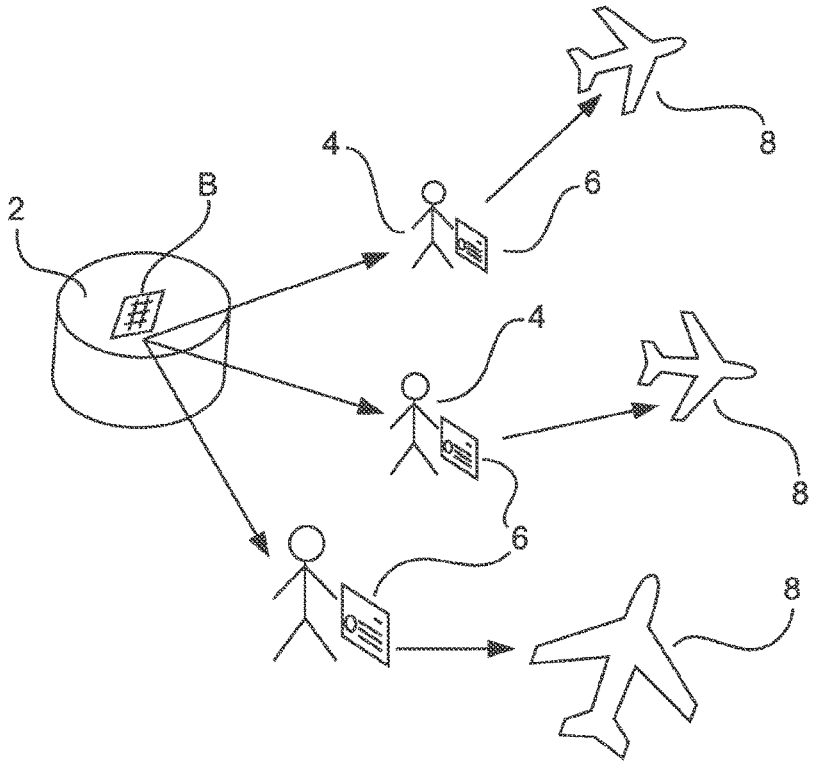
FIGS. 1A and 1B diagrammatically show the basic function of the identification medium and proof of identification by means of basic feature elements.

FIG. 1A shows a central rights management unit 2 in which in relation to several users 4 individual privileges for access to a vehicle 8 in the form of an aircraft 8 are managed and defined. The central rights management unit 2 is to be understood as a core component of an access system according to the present disclosure, because any user 4 may only gain permission to enter an aircraft 8 or to use various systems installed therein if they are issued with a corresponding privilege in the central rights management unit 2.

Privileges may be defined in the form of privilege schemes that are, for example, dependent on particular user roles. Such roles are to be viewed in the form of intended tasks that are to be carried out by a respective user 4. In one example, abstract user identifications are assigned to individual users 4, which user identifications make it possible in the rights management unit 2 to be independent of real names or other personal user information while nevertheless distributing individual privileges. Users 4 with their respective user role are assigned privileges in that, for example, in a privilege matrix B individual users 4 are linked to user roles, user groups or privilege schemes. This privilege matrix may be called up by an external device in that the rights management unit is queried, for example, about the user role or about the privilege scheme of a user 4 who has been authenticated prior to this.

Furthermore, in each case each user 4 receives an individual identification medium 6 that comprises an authentication unit with inherent verification mechanisms that allows decentralized authentication of a user 4 on the basis of several feature elements without the necessity of transmitting person-related data, as will be explained in more detail below. In one example, an access system according to the present disclosure for access control to an airport may be used at which airport a multitude of aircraft 8 operate, wherein access to individual areas of the airport and to the aircraft 8, which areas are separate of each other, is particularly critical in terms of security.

Figure 1B:
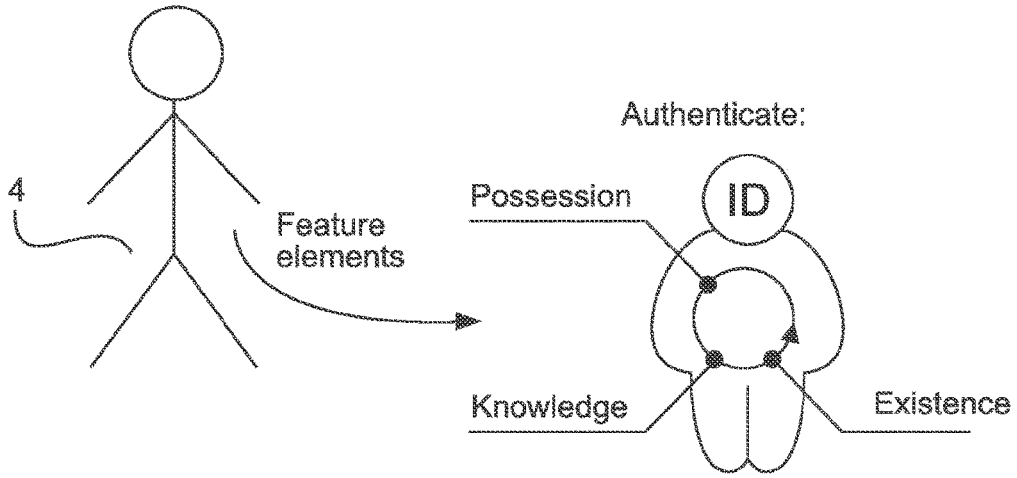

FIG. 1B shows three feature elements which in a process of authenticating are used to prove the identity of the user 4. First "possession" of an identification medium 6 is necessary; furthermore the "knowledge" of a secret, for example a password or a personal identification number (PIN). A third element, the "existence", represents one or several physical features that are verifiable in the form of so-called biometric data. Known biometric features include, for example, the biometric data of a fingerprint, a face, or an iris, or as an alternative also voice recognition, for example by means of formant analysis. Depending on the combination and manifestation of these feature elements, the level of security during authentication may be adjusted.

Figure 2A:
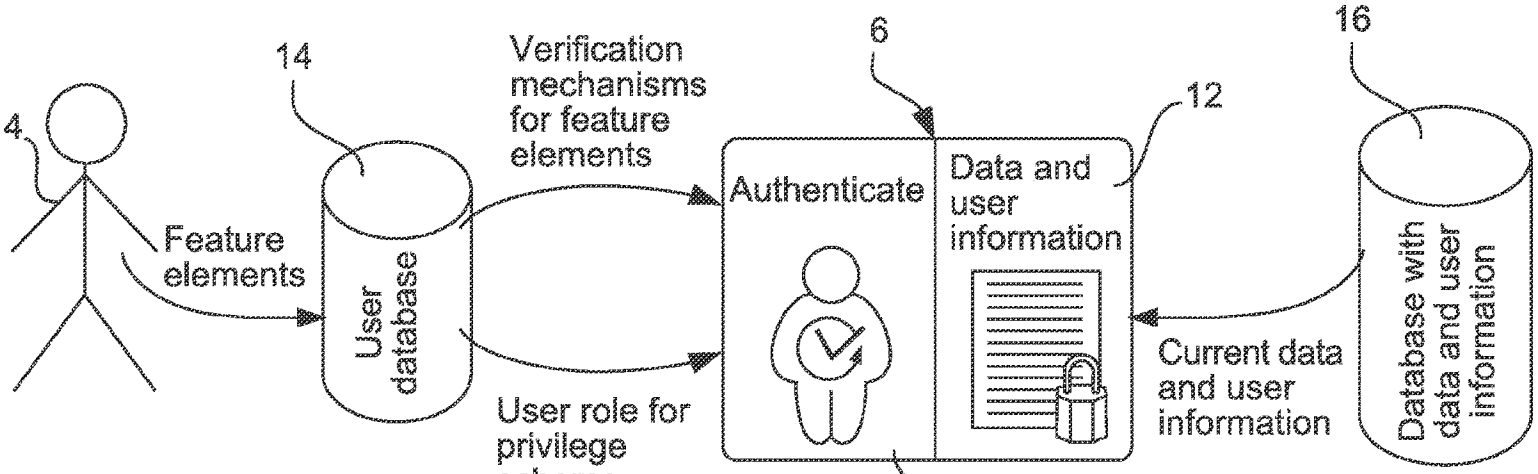
FIGS. 2A, 2B and 2C show various block-based schemes of the manner in which access control by the access system according to the present disclosure or by the method for managing access is carried out.

FIG. 2A shows the identification medium 6 as well as its preparation for a specific user 4. In order to compile the data necessary for this, feature elements of the user 4 are recorded for reliable user authentication, and in the form of verification mechanisms are incorporated in a user's electronic identification medium 6 in an authentication part 10. This part comprises several electronic components that are adapted for carrying out verification algorithms. Furthermore, the specific role of the user 4 is communicated to the identification medium 6, from which role a privilege scheme for subsequent authorization, for example in an aircraft 8, is derived.

In this arrangement the feature elements may be transferred to a user database 14, which, for example, forms part of a central rights management unit that is designed, based on the aforesaid, to establish verification mechanisms, to define an intended user role, and to transfer all the data to the authentication part 10 of the identification medium. The user database 14 and access control devices, for example on or in an aircraft 8, also comprise information relating to the basic privilege schemes. In one example, the necessary data is acquired only once, in the presence of the user and of a person authorized to issue an identification medium, and used for once-only issuing of the identification medium. Thereafter the relevant data is generally to be deleted.

Furthermore, during issuing of the identification medium 6, current privilege data relating to the aircraft 8 is moved from a database with privilege data, which database also forms, for example, part of the central rights management unit, to the identification medium 6 to a data part 12. The privilege data may comprise data fields that have been correlated in tabular form, which data fields define assignments of users and privilege schemes.

Figure 2B:
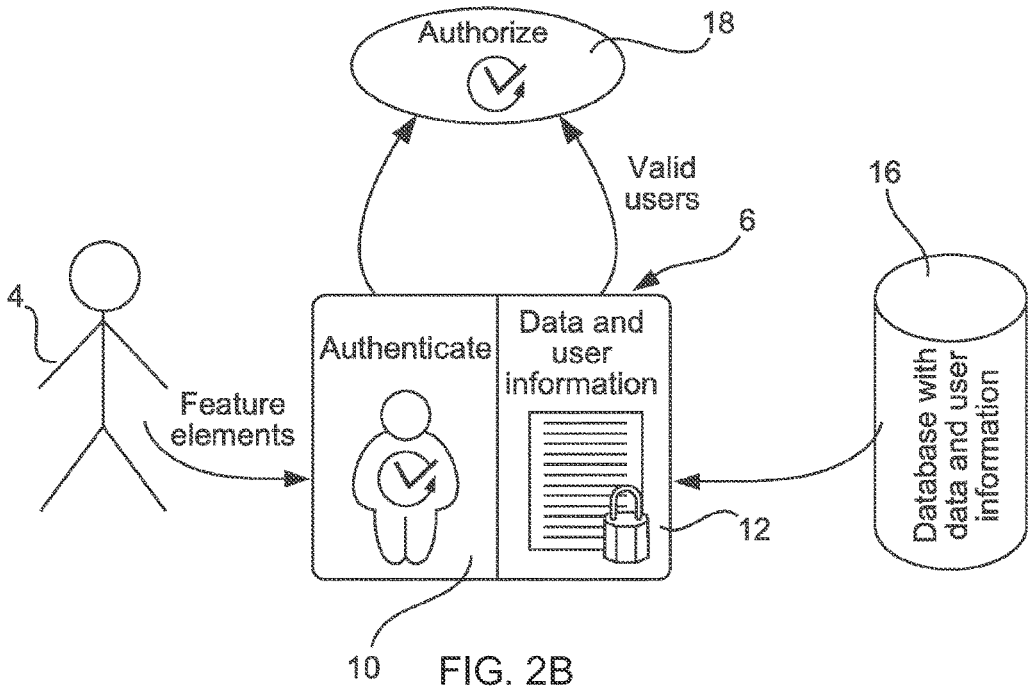

The process of authenticating and authorizing is, furthermore, shown in FIG. 2B. A user 4, who carries their personal identification medium 6 on their person is at an access control device 18 (shown diagrammatically) that is, for example, located at an exit from an airport building, which exit leads to an airfield. To furnish proof of their identity, the user 4 first needs to be in possession of the identification medium 6. In addition the user 4 needs to substantiate a secret, for example a password or a PIN and/or a physical biometric feature. The verification mechanisms stored on their electronic identification medium 6 verify the identity of the user 4 and transmit to the access control device 18 the confirmed identity of the user 4 and their associated user role.

Based on a data connection between the access control device 18 and the central rights management unit 16, after completion of authentication the rights management unit 16 may ask for the associated privilege scheme for the user 4. The access control device 18 thus obtains current information as to the particular privileges the user 4 has.

Parallel to the above, updated privilege data relating to the particular vehicle or aircraft 8 may be transmitted from the central rights management unit 16 to the data part 12 of the identification medium 6, which privilege data may comprise privileges, membership of user groups and enabled privilege schemes for the current user 4 and for any required number of further users. The stored updated privilege data may be used to update privilege data present in access control devices without data connections. In this arrangement each identification medium 6 serves as a data source. In the case of a high frequency of usage by a multitude of users 4, good up-to-dateness may be achieved by a resulting viral epidemic data transmission.

After completion of authentication and data transmission the access control device 18 authorizes the user 4 to pass, for example to enter an airfield. This may be carried out by transmitting a corresponding signal or order to a barrier, to a gate or the like.

Figure 2C:
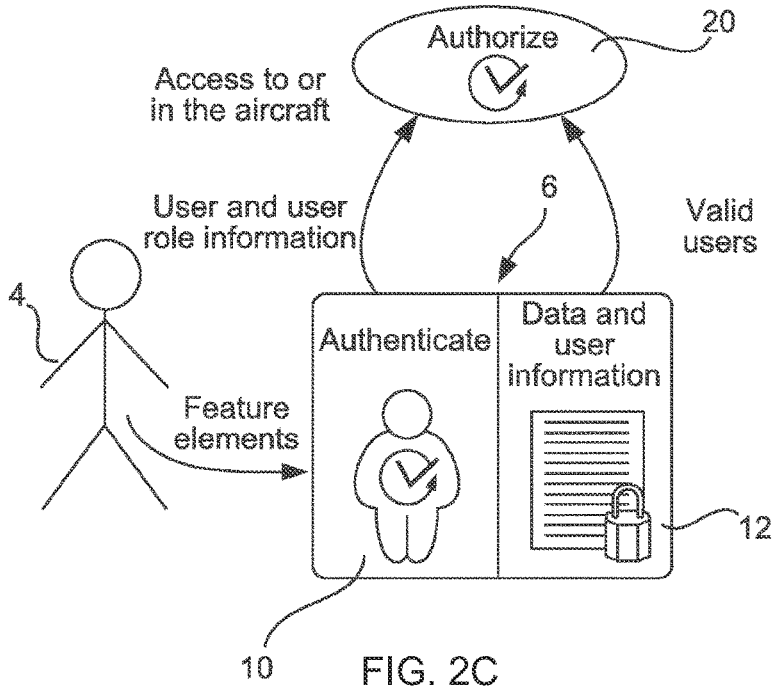

An access control device 20 without a data connection is shown in FIG. 2C. The privilege data present in that arrangement exclusively originates from identification media 6 that were brought in by users 4 and that were used to enable privileges following authentication. The user carries their identification medium 6 with updated privilege data on their person and by means of the authentication part 10 carries out authentication. Subsequently the confirmed identity of the user 4 and the user's defined role is transmitted to the access control device 20, which is, for example, arranged on or in an aircraft 8. At the same time the identification medium 6 transfers to the access control device 20 the updated privilege data carried along by the user 4. For the purpose of exclusive access control (blacklist) it would be possible to subsequently check whether the privilege data carried on the person does not exclude the confirmed and transmitted identity. If this is not the case, the user 4 is authorized according to their defined role. This process is used analogously also in the case of other users and aircraft.

Figure 3A:
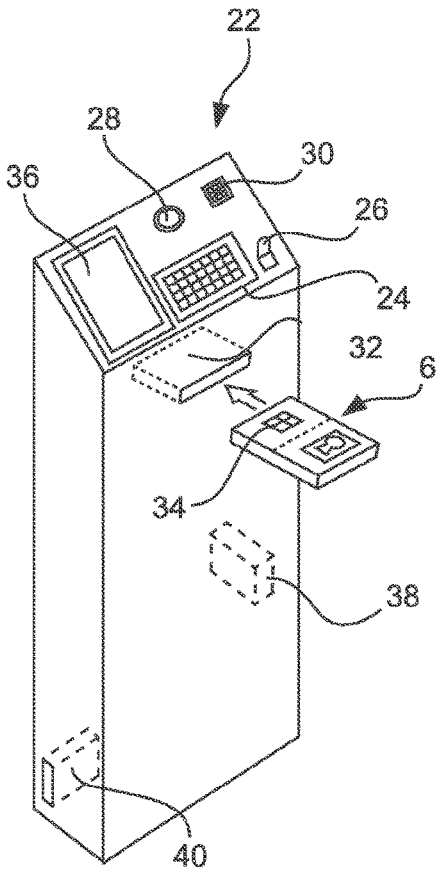
FIGS. 3A, 3B and 3C show two exemplary access control devices and their possible use at an airport.

FIG. 3A shows a possible exemplary embodiment of an access control device 22 that is designed for use of an identification medium without its own input means. The access control device is, merely as an example, designed as a columnar terminal whose essential elements that are evident to a user 4 are input means and a connecting means 32. A user is in the position to insert their identification medium 6 into, for example, a shaft-like connecting means 32 in which, for example, by means of an electrical contact 34 of the identification medium 6 a connection to input means and output means is established. The input means may, for example, comprise a keyboard 24, a fingerprint scanner 26, a camera 28 and a microphone 30, depending on the applicability. A display 36 makes it possible for the user 4 to follow instructions and to monitor progress of the authentication process. The access control device 22 may comprise a data connection unit 38 that allows a connection to a central rights management unit. Furthermore, a control output 40 should be provided that is necessary for communicating the systems to be driven and that during authorization issues corresponding control commands.

Figure 3B:
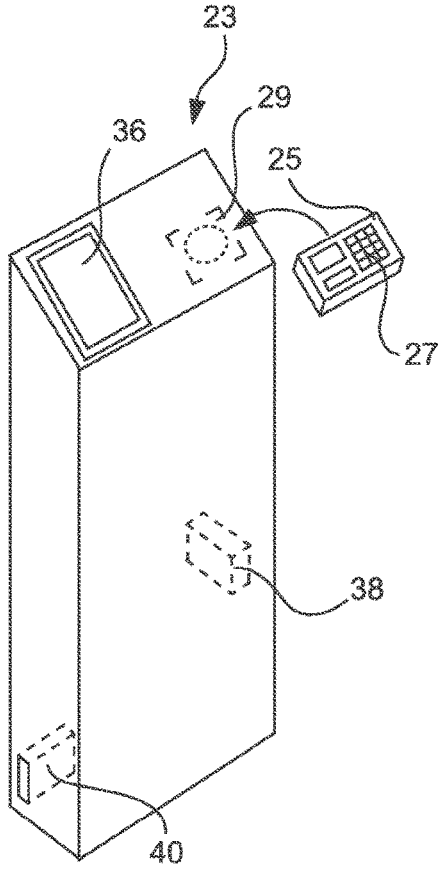

As an alternative, FIG. 3B shows an access control device 23 which for use of an identification medium 25 comprises its own input means 27. For connection to the identification medium a wireless connecting device 29 is used which apart from transmitting electrical energy for operating the identification medium and the authentication unit integrated therein also supports a data connection between the identification medium and the access control device 23. The input means 27 may, for example, be designed at least as a keyboard and a fingerprint scanner.

Figure 3C:
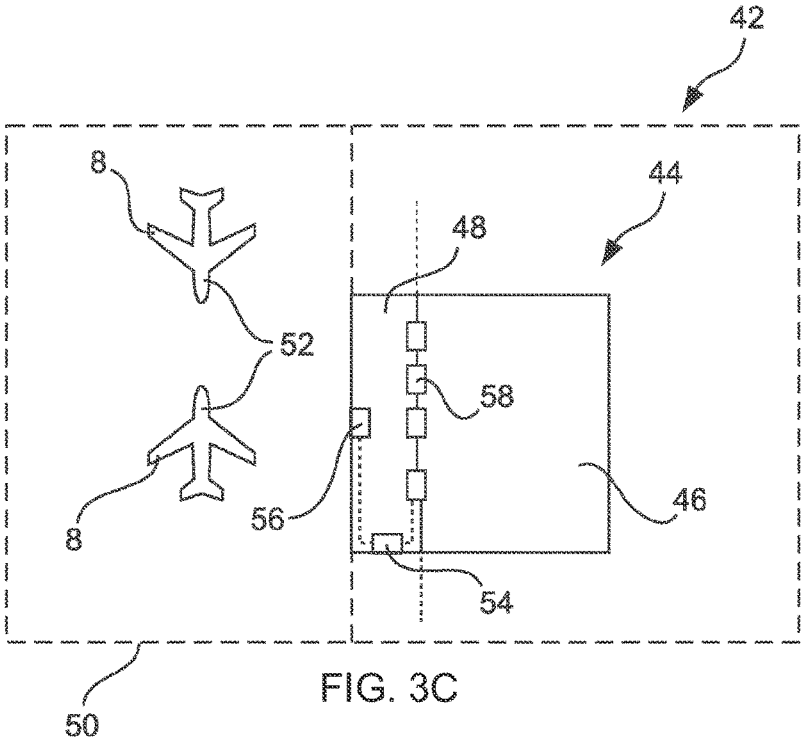

FIG. 3C diagrammatically shows the possible applicability of access control devices in an airport 42 that comprises, for example, an airport building 44 with a public area 46, a security zone 48 and an airfield 50. Several aircraft 8 are situated in the airfield 50, each comprising an access control device 52 that does not have a data connection to a central rights management unit 54 which, for example, is located in the security zone 48 of the airport building 44. Accordingly, the access control devices 52 in the aircraft depend on viral epidemic transmission of updated privilege data.

In order to get to the airfield 50 an access control device 56 must be passed that comprises a data connection to the central rights management unit 54. The user 4, who gets to the airfield 50, for example by authentication and authorization, carries on their person updated privilege data that is stored on the identification medium 6 during authentication.

Furthermore, the security zone 48 is reached by way of one of several access control devices 58, which as stationary devices that are operated permanently also comprise data connections to the central rights management unit 54.

Figure 4:
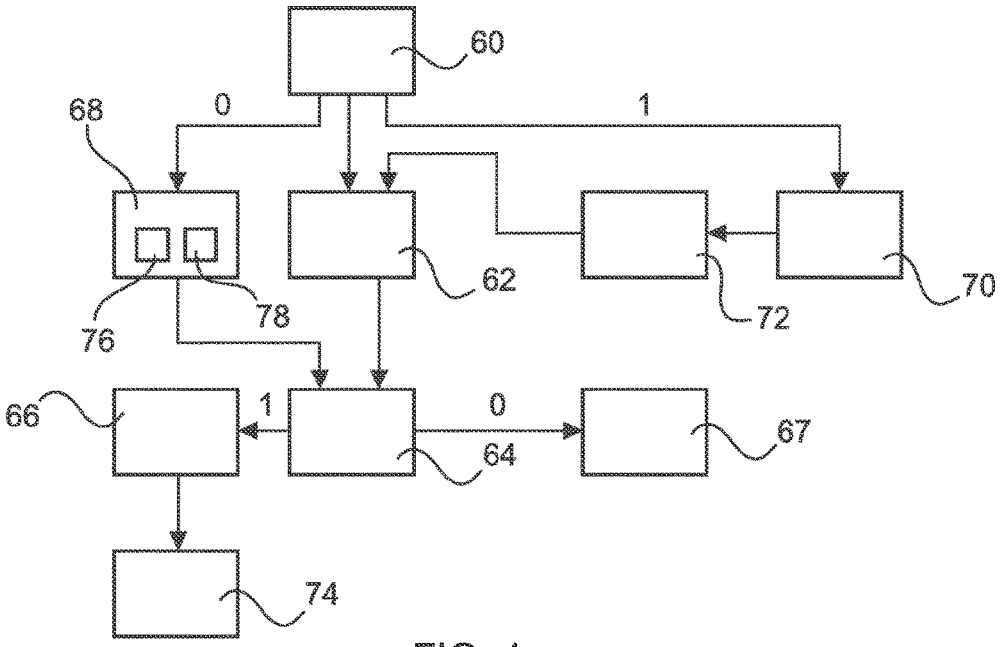
FIG. 4 shows a diagrammatic block-based view of the method according to the present disclosure.

FIG. 4 finally shows a diagrammatic sequence of a method for controlling access to a vehicle or to a vehicle system. A connection between an identification medium and an access control device is established 60. This need not necessarily take place at commencement of the method. Instead, it is necessary for authentication to be able to take place only if an access control device is in the immediate vicinity so that following authentication, authorization may be carried out promptly in order to avoid any misuse, for example of a stolen identification medium that a short time ago carried out authentication. By way of the input means, the identification medium inquires 62 about features, which for example comprise physical biometric features and the knowledge of a particular secret, and verifies 64 their correctness. If the feature elements called up by the user can satisfy the verification mechanisms inherent in the identification medium, the identification medium concludes that the user has successfully authenticated themselves and transmits to the access control device information stating that the user has successfully authenticated 66 themselves, and stating the particular privilege role of the user. If verification is not successful, the authentication method is terminated 67.

In one example, after establishment of the connection 60, at the same time user privilege data is called up 68 from the identification medium, provided the access control device does not have a data connection to a central rights management unit. However, if the latter is the case, updated privilege data is called up 70 from a central rights management unit and is transmitted 72 to the identification medium. Subsequently the user role or the abstract user identification is correlated 74 with the privilege data, after which authorization 76 takes place, for example by issuing control commands or the like.

Calling up data from the data part of the identification medium when there is no connection to a central rights management unit also includes calling up 76 priority features and a comparison 78 with priority features of previously loaded privilege data in order to make a decision as to which set comprising privilege data is the dataset to be prioritized. In this arrangement, priority features may be implemented in the form of time stamps or the like.

By means of the access system according to the present disclosure and the method according to the present disclosure for controlling access to a vehicle even in the case of an incomplete infrastructure, extensive vehicle movements and very substantial fluctuations in personnel it is nevertheless possible to achieve very high security and reliability of enabling access and vehicle functions.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

What is claimed is:

1. An access system for an aircraft, comprising:

a central rights management unit for interlinking and providing user identification and associated user rights, at least a first access control terminal situated outside of the aircraft, wherein the at least a first access control terminal comprises a data connection to the central rights management unit, a second access control terminal that does not comprise a direct connection to the central rights management unit, at least one portable identification medium that includes an authentication unit and is configured, in the authentication unit, to run through verification mechanisms for user authentication, and to transmit to the at least a first access control terminal information relating to a user authentication that has been carried out, and at least one input means for interacting with a user, wherein the at least a first access control terminal includes a connecting means for connection to the at least one portable identification medium and the at least a first access control terminal is configured to enable the associated user rights for an authorized user, wherein the at least one portable identification medium comprises an independent data part for storing updated user privilege data related to multiple users, which may or may not include the actual holder of the portable identification medium, the user privilege data being obtained from the central rights management unit via the at least a first access control terminal, wherein the second access control terminal is configured to retrieve and store the updated user privilege data from the independent data part to acquire knowledge of current associated user rights on the basis of the stored user privilege data that are called up from the portable identification medium, wherein the first and second access control terminals are configured to perform functions related to user authentication based on security data stored on the portable identification medium and accessed by the access control terminals during a user authentication procedure, and wherein the at least one portable identification medium is configured to store time stamp priority information associated with the updated user privilege data stored by the at least one portable identification medium, and wherein the at least one access control terminal is configured to: call up the time stamp priority information from the at least one portable identification medium, compare the called up time stamp priority information with other time stamp priority information relating to other known user privilege data, and make a decision as to which set of user privilege data to use, based on comparing the called up time stamp priority information with the other time stamp priority information.

2. The access system of claim 1, wherein the at least one input means is integrated in the at least one portable identification medium.

3. The access system of claim 1, wherein the at least one input means is integrated in the at least one access control terminal.

4. The access system of claim 1, wherein the authentication unit is configured to carry out authentication without a data connection.

5. The access system of claim 1, wherein the authentication unit is configured to transmit to the at least one access control terminal information relating to successful authentication of a user and abstract user identification.

6. The access system of claim 1, further comprising an electrical interface as a connecting means, which electrical interface is configured to establish a contact-based connection to the at least one access control terminal.

7. The access system of claim 1, wherein the at least one portable identification medium comprises a transmitting and receiving device that is configured, for the purpose of data transmission, to wirelessly communicate with an external transmitting and receiving device.

8. The access system of claim 1, wherein the first access control terminal is positioned in an airport building, and a second access control terminal without a data connection to a central rights management unit is associated with at least one aircraft outside the airport building.

9. A method for managing access for an aircraft, comprising the steps of:

connecting an identification medium comprising an authentication unit to a connecting means of a first access control terminal, the first access control terminal being situated outside the aircraft and having a data connection to a central rights management unit;

inquiring features of a user for authentication by way of an input means by the authentication unit;

verifying the correctness of the inquired features on the basis of data in the authentication unit;

after successful verification, transmitting information stating that the user has successfully authenticated themselves and stating the particular group of which the user forms part, from the authentication unit to the access control device;

correlating the user group with privilege data for receiving concrete user rights;

authorizing the user with concrete user rights;

calling up updated privilege data related to multiple users, which may or may not include the actual holder of the portable identification medium, from the central rights management unit by the access control terminal;

transmitting the updated privilege data to the identification medium;

calling up and storing updated privilege data from the identification medium by a second access control terminal to acquire knowledge of current associated user rights, provided no data connection exists between the second access control terminal and the central rights management unit;

providing time stamp priority information by the at least one portable identification medium, the time stamp priority information associated with the updated privilege data;

calling up time stamp priority information from the at least one portable identification medium by the at least one access control terminal;

comparing the called up time stamp priority information from the at least one portable identification medium with other time stamp priority information relating to to other known user privilege data; and making a decision as to which set of user privilege data to use, based on comparing the called up time stamp priority information with the other time stamp priority information;

wherein the first and second access control terminals are configured to perform functions related to user authentication based on security data stored on the portable identification medium and accessed by the access control terminals during a user authentication procedure.

* * * * *